US005649354A

United States Patent [19]

Fujii et al.

[11] Patent Number: 5,649,354

[45] Date of Patent: Jul. 22, 1997

[54] METHOD OF MANUFACTURING A FUEL INJECTOR CORE

[75] Inventors: Hiroyuki Fujii, Chiryu; Hitoshi Ichikawa; Toshihiro Imai, both of Nagoya, all of Japan

[73] Assignee: Nippondenso Co., Ltd., Kariya, Japan

[21] Appl. No.: 409,526

[22] Filed: Mar. 24, 1995

[30] Foreign Application Priority Data

| | | | |
|---|---|---|---|
| Mar. 25, 1994 | [JP] | Japan | 6-055781 |
| Apr. 8, 1994 | [JP] | Japan | 6-070730 |
| Feb. 9, 1995 | [JP] | Japan | 7-021915 |

[51] Int. Cl.[6] ..... H01F 41/02

[52] U.S. Cl. ..... 29/607; 29/602.1; 72/46; 83/22; 239/585.5

[58] Field of Search ..... 29/602.1, 607; 251/129.21; 239/585.5; 72/46, 326, 258; 83/22

[56] References Cited

U.S. PATENT DOCUMENTS

| | | | |
|---|---|---|---|
| 3,967,484 | 7/1976 | Takahashi et al. | 72/258 X |
| 5,033,716 | 7/1991 | Mesenich | 251/129.21 |
| 5,458,158 | 10/1995 | Kawanabe | 140/105 |

FOREIGN PATENT DOCUMENTS

| | | |
|---|---|---|
| 5223030 | 8/1973 | Japan . |
| 1166844 | 6/1989 | Japan . |

OTHER PUBLICATIONS

"Plasticity and Working" (in Japanese Sosei to Kako) vol. 24, No. 271, pp. 830–839 was published in Aug., 1983. see abstract.

*Primary Examiner*—Carl E. Hall

*Attorney, Agent, or Firm*—Cushman, Darby & Cushman IP Group of Pillsbury Madison & Sutro LLP

[57] ABSTRACT

A block of material used for making a movable core for a fuel injector is prepared from a bar or coil of material by clamp shearing using a working fluid containing an extreme-pressure additive (such as sulfur, chlorine or phosphorus). The additive reacts with the material to form a protective layer (of e.g. sulfide, chloride or phosphate) on the cut-off surface of the block. The block is cold forged so that its cut-off surface having the protective layer may form a wall defining a fuel passage. The layer prevents the material from being seized with any die or punch used for cold forging.

4 Claims, 7 Drawing Sheets

Z μm<Rmax<10 μm

PRESENT INVENTION

Rmax<2 μm

METHOD OF MANUFACTURING A FUEL INJECTOR CORE

CROSS REFERENCE TO THE RELATED APPLICATIONS

This application is based upon and claims priority from Japanese Patent Application No. Hei. 6-55781 filed Mar. 25, 1994, Japanese Patent Application No. Hei. 6-70730 filed Apr. 8, 1994 and Japanese Patent Application No. Hei. 7-21915 filed Feb. 9, 1995, with the contents of each document being incorporated herein by reference.

BACKGROUND OF THE INVENTION

1. Field of the Invention

This invention relates to an injector for supplying a jet of fuel into e.g. an internal combustion engine in an automobile, its movable core and a method of manufacturing the same.

2. Description of the Prior Art

A conventional fuel injector has a needle housed movably in a body having at its bottom a valve seat on which the needle normally rests. If an electric current is supplied to a solenoid coil, it attracts the needle away from the valve seat and forms therebetween a clearance through which fuel flows. The fuel is injected through a fuel injection port at the bottom of the body. The injection of fuel is continued as long as the supply of the electric current is continued, and if the supply of the electric current is discontinued, the needle returns on the valve seat again to terminate the injection of fuel.

The parts composing the injector are required to be highly accurately made to ensure the accuracy of fuel injection. The known injector includes a movable core defining at its top a seat for a return spring adapted to close the fuel injection port. The repeated use of the injector is, however, likely to bring about an undesirable change in the load of the return spring and thereby a lowering in the accuracy of fuel injection.

The movable core defines a fuel passage therein, and is, therefore, required to have an accurate surface finish. While it has been usual to form such a core by turning from a bar, cold forging has come to be considered as a more efficient method for core manufacture.

It is, however, likely that a block of material from which a movable core is formed by cold forging may have microcracks in its cut surface, and that those microcracks may form fine flakes on the surface of the core as forged. Those flakes are likely to come off the core to some extent or other and close the fuel injection port. Japanese Patent Application Laid-Open (KOKAI) No. Hei 1-166844 proposes the removal of such flakes by shaving or grinding the cut surface of a block of material prior to cold forging. The proposed method is, however, likely to bring about a lowering of productivity and a rise in the cost of manufacture as new problems, though it may effectively overcome the problem of flakes.

Another problem is the likelihood of the cut surface of a block of material to be seized with a die (including a die and a punch) during cold forging.

SUMMARY OF THE INVENTION

Under these circumstances, it is an object of this invention to provide a process which can manufacture a movable core by cold forging with high productivity without allowing its material to be seized with a die.

It is another object of this invention to provide a fuel injector which can continue a reliable and stable supply of fuel at an accurate rate of injection even after its repeated use, and a movable core therefor.

We, the inventors of this invention, have found that a cut surface obtained by clamp shearing is an activated metal surface which is likely to be seized with a die during cold forging if the die and the cut surface in direct contact therewith are strongly rubbed against each other.

We have also found that a movable core formed by turning from a bar of material usually has a surface roughness, $R_{max}$, of 10 to 15 microns which has a significant bearing on the accuracy of fuel injection by a known injector, as the uneven surface of the core is used as the seat for the return spring for closing the fuel injection port. Although the return spring may have an accurately set length, its set length is likely to undergo a slight change as a result of its repeated use, since the unevenness on the surface of the core is thereby compressed. The change in its set length brings about a change in its load and thereby in the accuracy of fuel injection.

According to this invention, there is provided a process for manufacturing a movable core for a fuel injector which comprises the steps of providing material to be operated by clamp shearing, a cropping machine for the clamp shearing and a working fluid for clamp shearing containing a extreme-pressure additive to form a reaction layer on a cut-off surface of the material; performing clamp shearing to obtain a core material having a reaction layer on a cut-off surface formed by a reaction of said extreme-pressure additive and a heat generated by cropping; providing a machine for cold forging; and cold forging the material cut by the clamp shearing from the cut surface having the reaction layer so that the cut-off surface of the material having the reaction layer is deformed into an inner surface of the movable core acting as a fuel passage.

The heat generated by cropping promotes the reaction between the extreme-pressure additive, such as S, Cl or P, in the working fluid and the cut and activated surface of the material to form the reaction layer, which may, for example, be a layer of iron sulfide, chloride or phosphate if the material is steel. The reaction layer prevents the cut-off surface from being contacted directly by a die and rubbed strongly against it during cold forging.

The material to be forged is preferably so cropping as to have a ratio of a thickness against an outside diameter which is less than 1. The material so cropping calls for only a very small reduction in height. Therefore, it is not substantially hardened when upset, as opposed to any material upset at a high ratio, but it can easily be cold forged to yield a product having a high level of accuracy in shape and dimensions.

In other preferred mode of this invention, there is also provided a fuel injector which comprises a housing; a body fitted to the housing and holding a movable needle; a solenoid coil provided in the housing for drawing the needle away from a valve seat at the bottom of the body to enable an injection of fuel when the solenoid coil is deenergized or energized; a movable core connected to the needle and defining a fuel passage; a return spring biasing the needle to rest on the valve seat to terminate the injection when the solenoid coil is energized or deenergized, the core defining also a seat for the return spring; and means for restricting any change of a set length of the return spring caused by flattened rough surface on the seat for the spring by a load of the spring. The term "surface roughness" as used in this specification and in the appended claims means surface roughness as defined in No. B-0601 of Japanese Industrial Standard (which is abbreviated as JIS), the contents of which are hereby incorporated by reference.

BRIEF DESCRIPTION OF THE DRAWINGS

For a better understanding of the invention as well as other objects and features thereof, reference is made to the following detailed description to be read in conjunction with the accompanying drawings, wherein.

DETAILED DESCRIPTION OF THE INVENTION

Description will now be made of a few preferred embodiments of this invention with reference to the drawings.

First Embodiment

Figure 1:
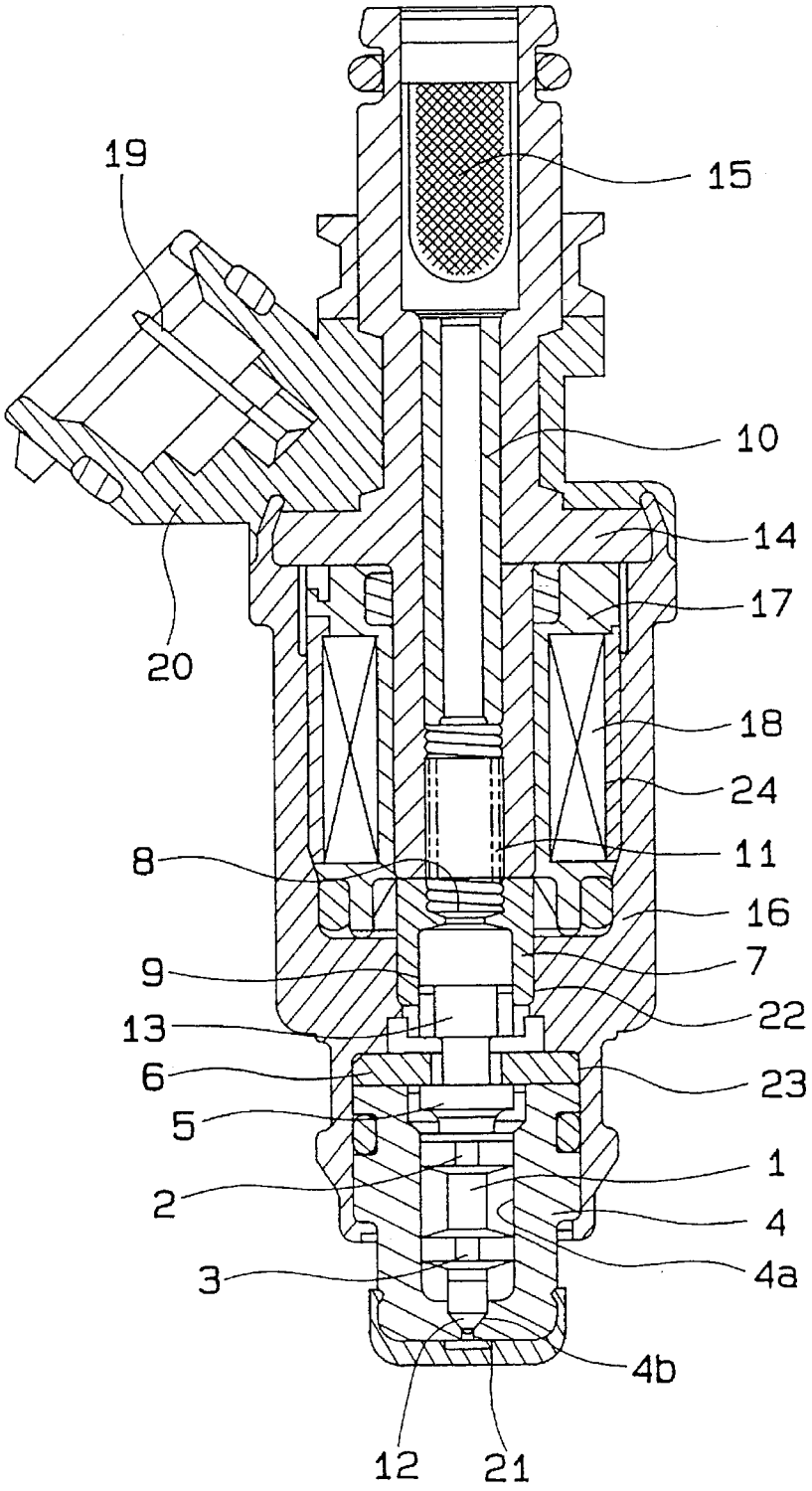
FIG. 1 is a longitudinal sectional view of a fuel injector for a gasoline engine according to a first embodiment of this invention.

A fuel injector for a gasoline engine embodying this invention is shown in FIG. 1. The injector has a body 4 in which a needle 1 is axially movably disposed. If an electric current is supplied to a solenoid coil 18, the needle 1 is drawn away from a valve seat 4*b* at the bottom of the body 4, whereupon a clearance is formed between the needle 1 and the valve seat 4*b* to allow the passage of fuel for injection through a fuel injection port at the bottom of the body 4.

The injection of fuel is continued as long as the supply of an electric current to the solenoid coil 18 is continued, and if the supply of an electric current is discontinued, the needle 1 returns on the valve seat 4*b* again to terminate the injection of fuel. The injector has a substantially cylindrical housing 16 formed from a magnetic material, in which a fixed iron core 14, a movable core 7, the needle 1 and the body 4 are axially mounted. A spool 17 formed from a resin is securely fitted in the housing 16. The solenoid coil 18 is wound on the spool 17. The housing 16 has a lower portion 23 in which an annular spacer 6 and the body 4 are fitted. The body 4 has a cylindrical inner surface 4*a* along which the guide portions 2 and 3 of the needle 1 are slidable, and the valve seat 4*b* on which the conical end portion 12 of the needle 1 is adapted to rest.

The fuel injection port 21 is in the center of the bottom of the body 4. The housing 16 has an intermediate portion 22 which is smaller in inside diameter than its lower portion 23, and in which the movable core 7 is fitted. The core 7 is a cylindrical body formed from a magnetic material. The movable core 7 has an outside diameter which is slightly smaller than the inside diameter of the intermediate portion 22 of the housing 16, so that it may be slidable along the inner surface of the intermediate portion 22. The core 7 has a top surface facing the bottom surface of the fixed iron core 14 in an appropriately spaced relation.

The needle 1 is joined by laser welding to the inner surface of the movable core 7 adjacent to its bottom. A return spring 11 is fastened to the top of the movable core 7 for urging the movable core 7 downwardly so that the conical end portion 12 of the needle 1 may rest on the valve seat 4*b* at the bottom of the body 4. The return spring 11 projects from the movable core 7 into the fixed iron core 14 and is supported by an adjusting pipe 10 secured in the fixed iron core 14. The adjusting pipe 10 is axially adjustable in position to adjust the biasing force of the return spring 11.

A filter 15 is provided at the top of the fixed iron core 14 for removing dust or other foreign matter from the fuel flowing from a fuel reservoir and a fuel pump into the fuel injection valve. The fuel entering the fixed iron core 14 flows through the adjusting pipe 10, a clearance between the movable core 7 and a flattened portion 13 on the connecting end portion 9 of the needle 1 and a clearance between the cylindrical inner surface of the body 4 and flattened portions 13 on the guide portions 2 and 3 of the needle 1, and reaches the fuel injection port 21.

The fixed iron core 14 has above the spool 17 a radially outwardly projecting portion on which a connector 20 formed from a synthetic resin is mounted. A terminal 34 which is electrically connected to the solenoid coil 18 is embedded in the connector 20 and the spool 17. The terminal 34 is connected to an electronic control device not shown by a wire harness, so that an energizing current may be supplied from the electronic control device to the solenoid coil 18 through the terminal 34. If the solenoid coil 18 is energized, the needle 1 and the movable core 7 are drawn toward the fixed iron core 14 by overcoming the biasing force of the return spring 10. The fuel supplied under pressure from the fuel pump and pressure regulator not shown, and entering the fixed iron core 14 at its top flows down through the filter 15, the adjusting pipe 10, the clearance between the movable core 7 and the flattened portion 13 on the end portion 9 of the needle 1 and the clearance between the cylindrical inner surface of the body 4 and the flattened portions 13 on the guide portions 2 and 3 of the needle 1, and reaches the valve seat 4*b*. The solenoid coil 18 produces an electromagnetic force upon energization by an electric current supplied through the terminal 34 in the connector 20. This electromagnetic force causes the movable core 7 and the needle 1 connected to it to ascend by overcoming the biasing force of the return spring 11 until the flange 5 on the needle 1 abuts on the spacer 6. The electromagnetic force of the solenoid coil 18 holds the needle 1 and the movable core 7 in their raised position. If an injection control signal ceases to be outputted to the solenoid coil 18, its electromagnetic force ceases to exist and the return spring 11 urges the needle 1 to descend so that it may rest on the valve seat 4*b*. The fuel flows through the clearance between the conical end portion 12 of the needle 1 and the valve seat 4*b* and the fuel injection port 21 to be injected to the intake valve of an internal combustion engine so as not to substantially adhere to the wall of an intake manifold not shown, as long as the needle 1 is in its raised position.

Figure 2:
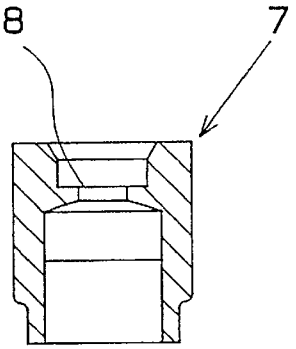
FIG. 2 is an enlarged longitudinal sectional view of the movable core in the fuel injector shown in FIG. 1.

Description will now be made of the manufacture of the movable core as shown in FIG. 2 with reference to FIG. 5 showing a process embodying this invention. FIG. 5A shows a solid cylindrical block of material prepared by cropping a bar or coil. The block is upset in a die to form an appropriately shaped block as shown in FIG. 5B. The block is, then, cold forged, or extruded into a cup-shaped product as shown in FIG. 5C. A seat is formed at the bottom of the cup-shaped product by punching, as shown in FIG. 5D. Then, a fuel passage is formed by punching through the center of the seat, whereby a movable core 7 is obtained, as shown in FIG. 5E. The seat 8 formed on the core 7 for the return spring has a surface roughness, $R_{max}$, of less than 10 microns.

Figure 3A:
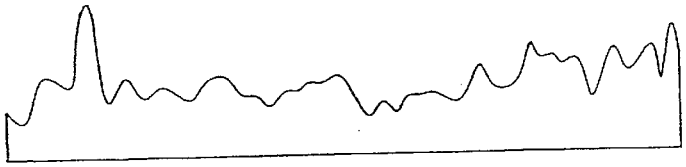
FIGS. 3A to 3C are graphical representations of the surface roughness, $R_{max}$, as determined in accordance with JIS on differently finished surfaces of movable cores.
Figure 3B:
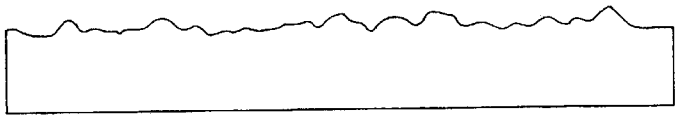
Figure 3C:
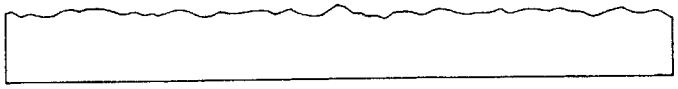
Figure 4:
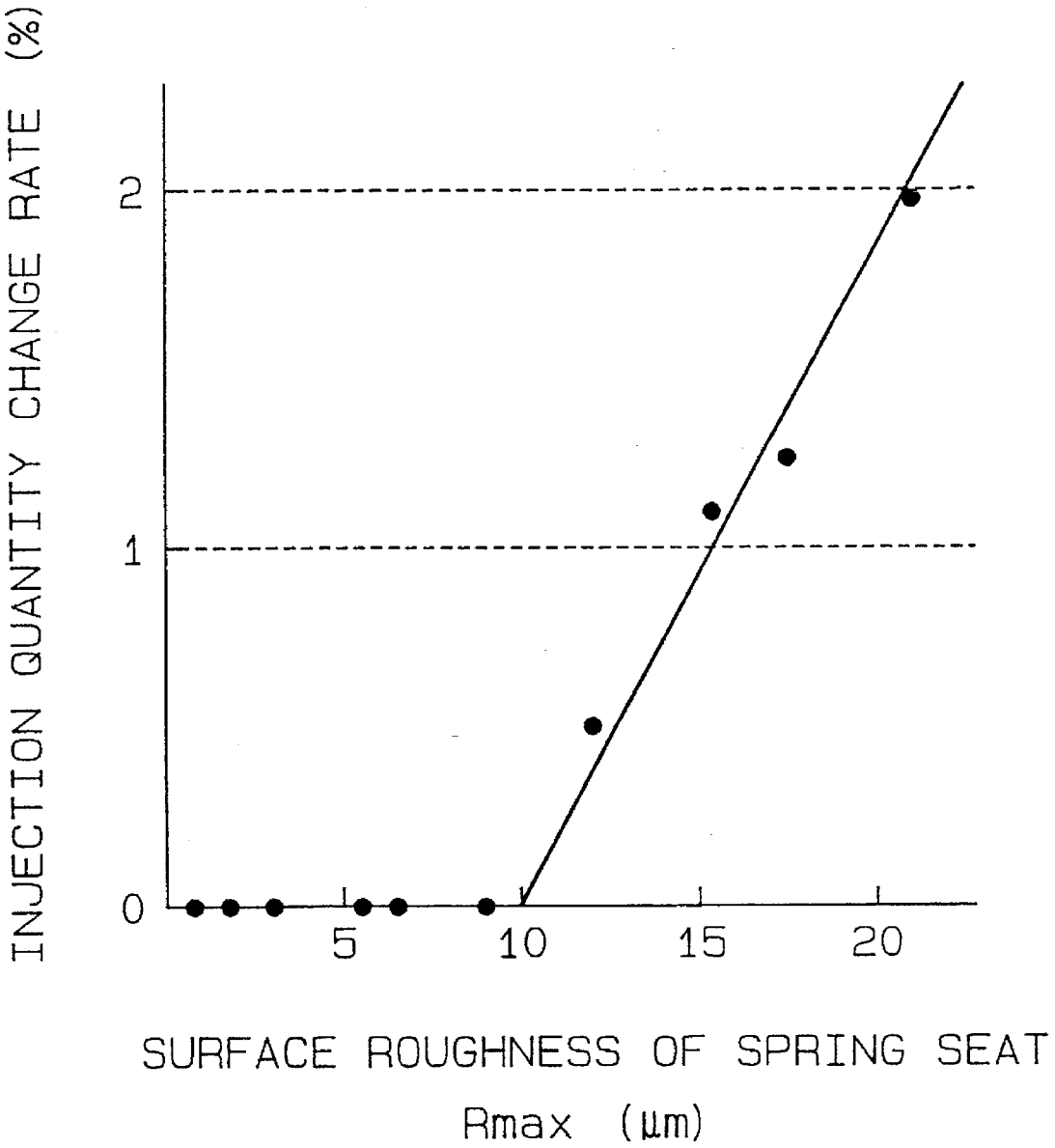
FIG. 4 is a graph showing a change caused by use in the amount of injection in relation to the surface roughness, $R_{max}$, as determined in accordance with JIS on the seat defined by the movable core for the return spring.
Figure 5A:
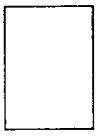
FIGS. 5A to 5E are a series of views illustrating the manufacture of the core by cold forging.
Figure 5B:
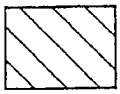
Figure 5C:
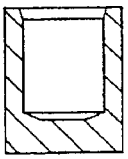
Figure 5D:
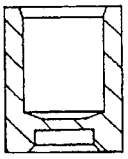
Figure 5E:
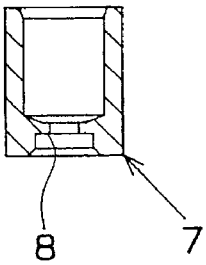

The injector having such a movable core is substantially free from any undesirable variation in the accuracy of fuel injection. Reference is made to FIGS. 3 and 4. FIG. 3 shows the surface roughness, $R_{max}$, as determined in accordance with Japanese Industrial Standard (JIS) on differently finished surfaces of the seat 8 for the return spring 11 on the movable core 7. FIG. 4 shows an injection quantity change rate which has occurred to the injection of fuel as a result of use, in relation to the surface roughness, $R_{max}$, of the seat 8 for the return spring 11 on the movable core 7. The products of this invention were compared with cores finished with a lathe and by polishing, and having different levels of surface roughness, $R_{max}$, as determined in accordance with JIS. As is obvious from FIG. 4, there was no change in the injection of fuel even after a certain period of use if the seat on the movable core 7 had a surface roughness, $R_{max}$, of less than 10 microns.

It is, thus, obvious that, if the seat on the movable core 7 has a surface roughness, $R_{max}$, of more than 10 microns, the flattening of its uneven surface by the return spring 11 results in a change of its set length and its load and thereby a variation in the accuracy of fuel injection, while no such problem occurs if its surface roughness, $R_{max}$, is less than 10 microns. The necessary surface finish can be obtained by any of a variety of methods including cutting grinding, polishing, shaving, blasting, and chemical or electrolytic polishing.

It is alternatively effective to harden the surface of the movable core 7, or form the core 7 and the return spring 11 from the same material of the same hardness, so that the core surface may not be deformed by the return spring 11.

The fuel injector as hereinabove described is, thus, essentially characterized by its means for restricting any change that may occur to the set length of the return spring as a result of the flattening of the uneven seat surface on the movable core by the return spring.

Second Embodiment

Figure 6:
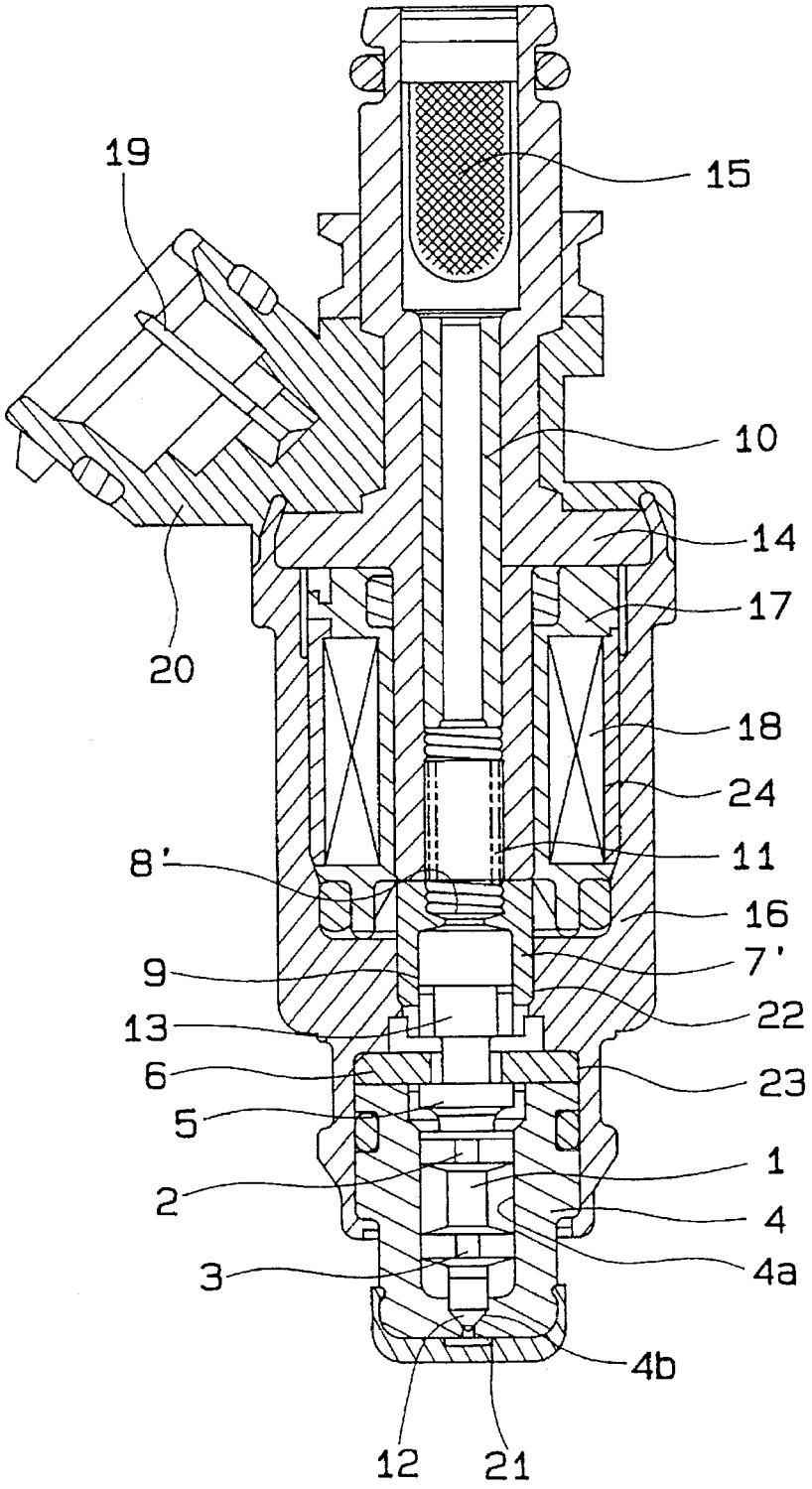
FIG. 6 is a longitudinal sectional view of a fuel injector for a gasoline engine according to a second embodiment of this invention.
Figure 7:
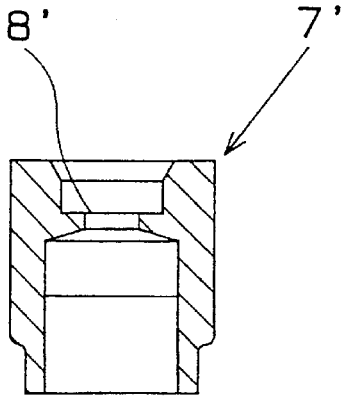
FIG. 7 is an enlarged longitudinal sectional view of the movable core in the fuel injector shown in FIG. 6.

A fuel injector embodying this invention is shown in FIG. 6. This injector is primarily intended for overcoming the problem which may arise from the flakes formed on the movable core made by cold forging, as hereinbefore pointed out. The injector as a whole is, however, identical in construction to the device which has been described with reference to FIG. 1. The numerals used in FIG. 1 are, therefore, used also in FIG. 6 to denote like parts, and no repeated description is made of any of the common features.

Figure 8A:
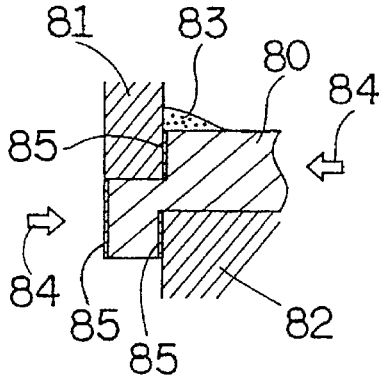
FIGS. 8A to 8E are a series of views illustrating the manufacture of the core by clamp shearing as shown in FIG. 8A, cold forging as shown in FIGS. 8B to 8D and punching as shown in FIG. 8E.

The fuel injector shown in FIG. 6 is characterized by its movable core 7'. The significant features of the movable core 7' can be described by the description of a process for manufacturing it. The process is shown by way of example in FIGS. 8A to 8E. FIG. 8A shows the step of preparing a solid cylindrical block of material by clamp shearing from a bar or coil. It has been usual for such a block to have a thickness to outside diameter ratio larger than 1, so that the deformation of the cropping material may be minimized. According to this invention, however, the block has a thickness to outside diameter ratio which is smaller than 1 (in conventional cropping method the ratio is more than 1), and yet its cropping material are deformed to a smaller extent than in the past. A working fluid 83 containing an extreme-pressure additive, such as S, Cl or P, is dropped between the material 80 to be cut and the cutter 81. The working fluid 83 may basically consist of, for example, a mineral oil, or a mixture of mineral and fatty oils. Confining forces 84 are applied to the material 80 from both side thereof. The clamp shearing of the material gives it an activated surface, and the heat generated by its cropping causes the reaction between the cut-off surface of the material and the extreme-pressure additive to form a reaction layer 85 which is a layer of, for example, sulfide, chloride or phosphate.

Figure 8B:
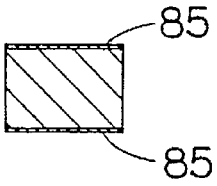

The block is upset in an appropriately shaped pattern to form an appropriately shaped block, as shown in FIG. 8B. The block having a thickness which is smaller than its diameter calls for only a small reduction in height, and is, therefore, not undesirably hardened as a result of upsetting. The block shown in FIG. 8B has a reaction layer on each of its top and bottom surfaces.

Figure 8C:
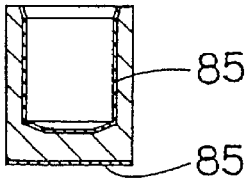

The block is, then, cold forged to have one of its cut-off surfaces depressed to form a cup-shaped body, as shown in FIG. 8C. As the material is not undesirably hardened, the block is easy to extrude rearwardly to form a cup-shaped body having a high level of accuracy in shape and dimensions.

Figure 8D:
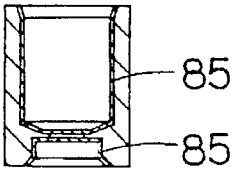

A seat for the return spring is formed by punching in the other cut-off surface, or bottom surface of the cup-shaped body, as shown in FIG. 8D. As the material is not undesirably hardened, the seat is easy to form with a high level of accuracy in shape and dimensions.

Figure 8E:
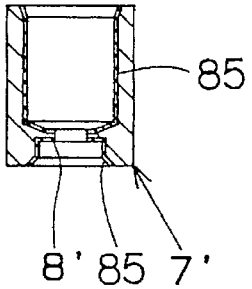

Finally, a fuel passage is formed by punching in the center of the seat 8', whereby a movable core 7' is obtained, as shown in FIG. 8E. As the material is not undesirably hardened, the fuel passage is easy to form by cold working. The wall defining the fuel passage may be shaved with a punch, if required.

According to the process of this invention, the die and punch which are used for cold forging are brought into contact with only those sides of the material which are covered with the reaction layers. Therefore, the material to be forged is unlikely to contact the die or punch directly and be thereby seized.

Figure 9A:
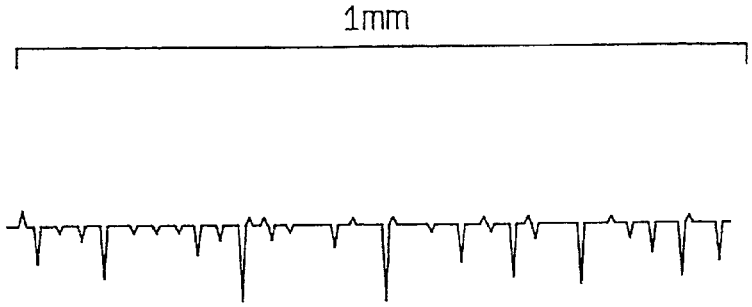
FIG. 9(a) CONVENTIONAL ART
FIGS. 9A and 9B are graphical representations of the surface roughness, $R_{max}$, as determined in accordance with JIS on differently finished surfaces of movable cores.
Figure 9B:
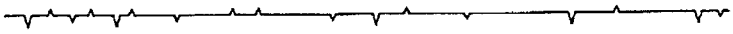

Inventors have studied a number of methods which can be employed for cropping a bar or coil of material to prepare a solid cylindrical block [see "Sosei to Kako" (Plasticity and Working), vol. 24, No. 271, published on August, 1983, pages 830 to 839]. We have concluded that it is preferable to employ fine cropping relying upon shearing. We have employed a clamp shearing method using a high hydrostatic pressure. FIGS. 9A and 9B compare in surface roughness a cold forged surface obtained from a cut surface prepared by such clamp shearing and (FIG. 9B) and a cold forged surface obtained from a cut-off surface prepared by a conventional method relying upon shearing involving fractured surface (FIG. 9B). The surface roughness was determined in accordance with Japanese Industrial Standard (JIS) B-0601, and L is set to be equal to 1 mm).

The surface roughness shown in FIG. 9A is due to the fine flakes formed by cold forging from the microcracks in the cut-off surface obtained by the conventional method. The microcracks are shown by deep cavities in FIG. 9A. On the other hand, the cut-off surface obtained by shearing in accordance with this invention is, for the greater part, or in its entirety, a very smooth surface which is free from any microcrack, as is obvious from FIG. 9B. There is no deep cavity corresponding to a microcrack. As a cut-off block of material has a thickness which is smaller than its diameter, it calls for only a small degree of upsetting, and can, therefore, form an upset body which is not undesirably hardened, but is easy to cold forge without developing any fine flake.

The movable core 7' is, thus, free from any fine flakes that would come off and clog the fuel injection port. The injector including the movable core 7' as described above can continue a reliable supply of fuel with a high accuracy of injection even after repeated use.

Third Embodiment

A process embodying this invention for manufacturing a fuel injector as shown in FIG. 1 is intended for overcoming any change that is likely to occur to the set length of the return spring as a result of the flattening of the uneven surface of the seat for the return spring on the movable core. The process includes the step of turning on and off the supply of an electric current to the solenoid coil repeatedly to bring the return spring into contact with the seat repeatedly until the uneven surface of the seat is flattened to the extent that the set length of the return spring is unlikely to change any more. As a result, the seat has a surface roughness as defined above.

What is claimed is:

1. A process for manufacturing a movable core for a fuel injector which comprises the steps of:

providing material to be operated on by a clamp shearing process, a cropping machine for said clamp shearing and a working fluid for said clamp shearing containing an extreme-pressure additive which forms a reaction layer on a cut-off surface of said material during the clamp shearing;

performing said clamp shearing to obtain a core material having a reaction layer on a cut-off surface formed by a reaction of said extreme-pressure additive and a heat generated by cropping;

providing a machine for cold forging; and cold forging said material cropped by said clamp shearing from said cut-off surface having said reaction layer so that said cut-off surface of said cut-off material having said reaction layer is deformed into an inner surface of said movable core acting as a fuel passage.

2. A process as set forth in claim 1, wherein said material has cylindrical shape and said clamp shearing step includes cropping said material to produce said core material having a ratio of a thickness against an outer diameter of said material which is less than 1.

3. A process as set forth in claim 1, wherein said cold forging step includes producing said inner surface of a extreme-pressure additive is an element selected from the group consisting of sulfur, chlorine and phosphorus, and said layer is of a compound selected from the group consisting of sulfide, chloride and phosphate.

4. A process as set forth in claim 2, wherein said cold forging step includes forming said inner surface having a surface roughness, $R_{max}$, of less than 10 microns.

* * * * *